US006328130B1

(12) United States Patent
Smith

(10) Patent No.: US 6,328,130 B1
(45) Date of Patent: Dec. 11, 2001

(54) LADDER ACCESSORIES

(76) Inventor: William Stephen Smith, 576 Cottingham Road, R.R. #2 Omemee, Ontario (CA), K0L 2W0

( * ) Notice: Subject to any disclaimer, the term of this patent is extended or adjusted under 35 U.S.C. 154(b) by 0 days.

(21) Appl. No.: 09/444,996

(22) Filed: Nov. 23, 1999

(30) Foreign Application Priority Data

Apr. 12, 1999 (CA) ..... 2268612

(51) Int. Cl.[7] ..... E06C 7/42
(52) U.S. Cl. ..... 182/107; 182/214; 182/121
(58) Field of Search ..... 182/107, 214, 182/129, 121; 248/210, 238

(56) References Cited

U.S. PATENT DOCUMENTS 3,792,750 * 2/1974 Madison ..... 182/214
4,401,187 * 8/1983 Van Patten .
4,949,810 * 8/1990 Dwinnell ..... 182/214
5,279,389 * 1/1994 Crockett ..... 182/214
5,293,957 * 3/1994 Lunden ..... 182/129
5,673,835 * 10/1997 Kalat .

FOREIGN PATENT DOCUMENTS

81404 * 6/1983 (EP) ..... 182/214

* cited by examiner

*Primary Examiner*—Alvin Chin-Shue
(74) *Attorney, Agent, or Firm*—Merek & Voorhees

(57) ABSTRACT

An accessory for releasably securing to a ladder. The accessory has at least one stabilizing arm for stabilizing and supporting the ladder when leaned against a building or structure. The stabilizing arm has a generally U-shaped configuration with a pair of generally parallel leg members that are spaced apart by a distance approximating the distance between the centers of adjacent ladder rungs. Each of the leg members ends in a ladder rung engaging member having a fore and an aft end, and is receivable within the hollow interior of a ladder rung. The ladder rung engaging members are oriented in a convergent configuration such that inserting them the hollow interiors of a pair of ladder rungs causes the fore and aft ends of the ladder rung engaging members to bind against opposite sides of the interior surfaces of the ladder rungs, and to releasably secure the stabilizing arm to the ladder.

6 Claims, 16 Drawing Sheets

LADDER ACCESSORIES

FIELD OF THE INVENTION

This invention relates to accessories for a ladder that expand and augment the uses of a ladder. The invention may also be used to enhance the safety features of a ladder.

BACKGROUND OF THE INVENTION

Ladders are typically comprised of a series of tubular rungs spaced apart at regular intervals and connected to and spanning a pair of longitudinal side rails. For purposes of weight reduction, and to minimize cost, in most instances the ladder's rungs are hollow and are fastened to the longitudinal side rails in such a manner that the ends of each rung are exposed along the exterior surface of each side rail. Ladders may be of a fixed length, such as a single section ladder or a step ladder. Ladders may also be of a variable length, such as in the case of an extension ladder.

Others have proposed the insertion of a variety of different devices and accessories into the hollow interior of a ladder's rung to provide support mechanisms, means to hang objects and devices from the ladder, and for a variety of other reasons. However, such prior devices tend to be complicated structurally, difficult and expensive to manufacture, and their attachment to the ladder is often difficult and time consuming. Such pre-existing devices are also severely limited in their capacity to assist in securing or maintaining the base or foot of a ladder securely to the ground or an object, and provide little assistance when ladders are used on elevated structures such as on the roof of a house or building. There is therefore the need for ladder accessories that may be easily and quickly secured to a ladder, that are simple and inexpensive to manufacture, and that enhance the safe operation of the ladder in a wide variety of different applications.

SUMMARY OF THE INVENTION

The invention therefore provides accessories for releasably securing to a ladder that are simple to apply, inexpensive to manufacture, and enhance the use and/or safe operation of a ladder.

Accordingly, in one of its aspects the invention provides an accessory for releasably securing to a ladder, the ladder being of the type having a series of generally parallel, hollow, evenly spaced, tubular, open ended rungs spanning and passing through a pair of longitudinal side members, the accessory comprising at least one stabilizing arm for stabilizing and supporting the ladder when leaned against a building or structure, said stabilizing arm having a generally U-shaped configuration with a pair of generally parallel leg members, said leg members spaced apart by a distance approximating the distance between the centers of adjacent ladder rungs, each of said leg members ending in a ladder rung engaging member having a fore and an aft end and receivable within the hollow interior of a ladder rung, said ladder rung engaging members oriented in a convergent configuration such that insertion of said ladder rung engaging members into the hollow interiors of a pair of ladder rungs causes said fore and aft ends of said ladder rung engaging members to bind against opposite sides of the interior surfaces of the ladder rungs to releasably secure said stabilizing arm to the ladder.

In a further aspect the invention provides an accessory for releasably securing to a ladder, the ladder being of the type having a series of generally parallel, hollow, evenly spaced, tubular, open ended rungs spanning and passing through a pair of longitudinal side members, the accessory comprising a pair of stabilizing arms for stabilizing and supporting the ladder when leaned against a building or structure, said stabilizing arms having a generally U-shaped configuration with a pair of ladder rung engaging members receivable within the hollow interiors of a pair of ladder rungs, said ladder rung engaging members oriented in a convergent configuration so that the fore and aft ends of said ladder rung engaging members bind against opposite sides of the interior surfaces of the rungs to releasably secure said stabilizing arms thereto; a safety rail, said safety rail having at least one pair of leg members releasably securable to opposite sides of the ladder such that when secured to the ladder said safety rail presents an enclosure to limit the likelihood of falls by individuals when working on a ladder; and, a pair of hand rails, one of said hand rails releasably securable to each side of the ladder to provide assistance to individuals working and climbing thereon.

In a further aspect the invention provides an accessory for releasably securing to a ladder, the ladder being of a type having a series of generally parallel, hollow, evenly spaced, tubular, open ended rungs spanning and passing through a pair of longitudinal side members, the accessory comprising at least one stabilizing arm for stabilizing and supporting the ladder when leaned against a building or structure, said stabilizing arm having a pair of leg members joined at one end, said leg members at their opposite ends ending in ladder rung engaging members, said ladder rung engaging members having a fore and an aft end and receivable within the hollow interior of a ladder rung, said ladder rung engaging members oriented in a convergent configuration such that insertion of said ladder rung engaging members into the hollow interiors of a pair of ladder rung causes said fore and aft ends to bind against opposite sides of the interior surfaces of the ladder rungs and to thereby releasably secure said stabilizing arm to the ladder.

In a still further aspect the invention provides an accessory for releasably securing to a ladder, the ladder being of the type having a series of generally parallel, hollow, evenly spaced, tubular, open ended rungs spanning and passing through a pair of longitudinal side members, the accessory comprising a tool hanger having attached thereto a ladder rung engaging member, said ladder rung engaging member of a dimension to allow for insertion into the hollow interior of a tubular ladder rung, said ladder rung engaging member being arched, with an apex and fore and aft ends, such that when inserted into the hollow interior of a ladder rung said apex and said fore and aft ends of said arched ladder rung engaging member contact and bind against the interior surface of the ladder rung to releasably secure said accessory thereto.

In another aspect the invention provides an accessory for releasably securing to an extension ladder to permit the ladder to be used on the inclined roof of a building or structure, the ladder being of the type having a series of generally parallel, hollow, evenly spaced, tubular, open ended rungs spanning and passing through a pair of longitudinal side members, the accessory comprising at least one ridge hook releasably securable to the upper end of the extension ladder and for hooking over the peak of an inclined roof, said ridge hook including at least one ladder rung engaging member with a fore and an aft end, said ladder rung engaging member receivable within the hollow interior of a ladder rung, said fore and aft ends of said ladder rung engaging member binding against opposite sides of the interior surface of the ladder rung to releasably secure said ridge hook thereto; and, at least one ladder locking device to releasably secure separate sections of the extension ladder together and prevent their accidental separation.

In yet a further aspect the invention provides an accessory for releasably securing to an extension ladder to permit the ladder to be used on the inclined roof of a building or structure, the ladder being of the type having a series of generally parallel, hollow, evenly spaced, tubular, open ended rungs spanning and passing through a pair of longitudinal side members, the accessory comprising at least one ridge hook releasably securable to the upper end of the extension ladder and for hooking over the peak of the inclined roof; and, at least one ladder locking device to releasably secure separate sections of the extension ladder together and prevent their accidental separation, said ridge hook and said at least one ladder locking device when secured to the ladder, permitting the ladder to be securely held upon the inclined roof of a building or a structure and allowing the ascent or decent of an individual over the roof's structure through climbing upwardly or downwardly upon the ladder's rungs.

In another aspect the invention provides an accessory for releasably securing to a ladder to help prevent unexpected or undesired movement of the base of the ladder, the ladder being of the type having a series of generally parallel, hollow, evenly spaced, tubular, open ended rungs spanning and passing through a pair of longitudinal side members, the accessory comprising a pair of anchoring arms releasably securable to the rungs of the ladder and having means to rigidly secure the base of the ladder to the ground or an object, said anchoring arms including ladder rung engaging members having fore and aft ends, said ladder rung engaging members receivable within the hollow interiors of the rungs of the ladder and forming an acute angle with said anchoring arms such that when said anchoring arms are adjacent and generally parallel to the sides of the ladder with said ladder rung engaging members inserted into the hollow interiors of the ladder rungs, said fore and aft ends of said ladder rung engaging members bind against opposite sides of the interior surface of the ladder rungs to releasably secure said anchoring arms thereto.

The invention also provides for a kit of accessories for releasably securing to a ladder to expand the uses of the ladder and to enhance the ladder's safety features, the ladder being of the type having a series of generally parallel, hollow, evenly spaced, tubular, open ended rungs spanning and passing through a pair of longitudinal side members, the kit comprising a pair of stabilizing arms for stabilizing and supporting the ladder when used in an upright position and leaned against an object or a building; a pair of hand rails releasably securable to the rungs of the ladder to provide assistance to individuals working and climbing thereon; and, a pair of anchoring arms releasably securable to the lower end of the ladder for releasably securing the ladder to the ground or an object, each of said stabilizing arms, said hand rails, and anchoring arms including ladder rung engaging members receivable within the hollow interior of a ladder rung, said ladder rung engaging members having fore and aft ends such that inserting said ladder rung engaging members into the hollow interiors of a ladder's rungs causes the fore and aft ends of said ladder rung engaging members to bind against opposite sides of the interior surfaces of the rungs to releasably secure said support arms, said hand rails and anchoring arms to the ladder.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
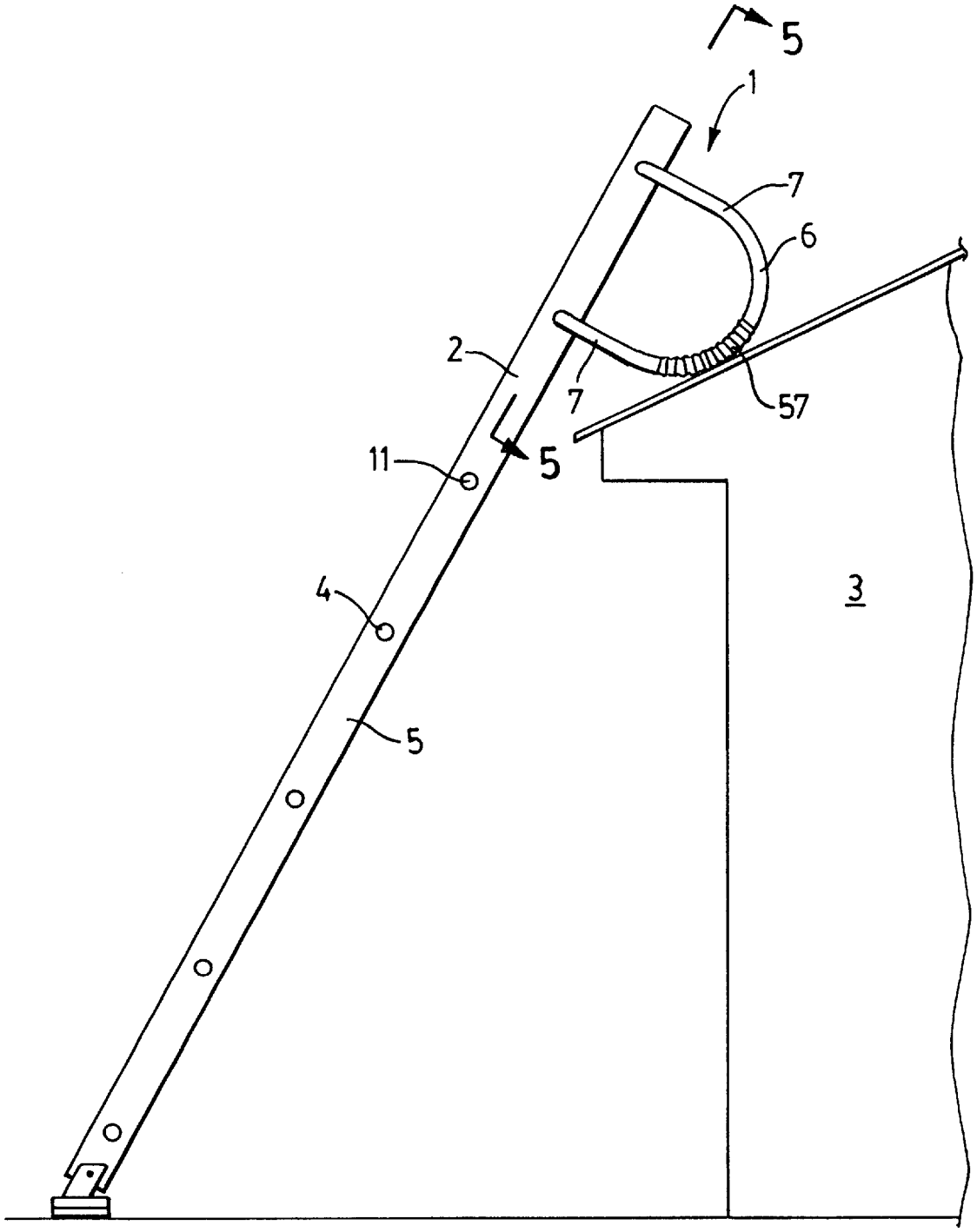
FIG. 1 is a side view of a ladder having attached thereto an accessory pursuant to the present invention wherein the accessory comprises a support arm.
Figure 2:
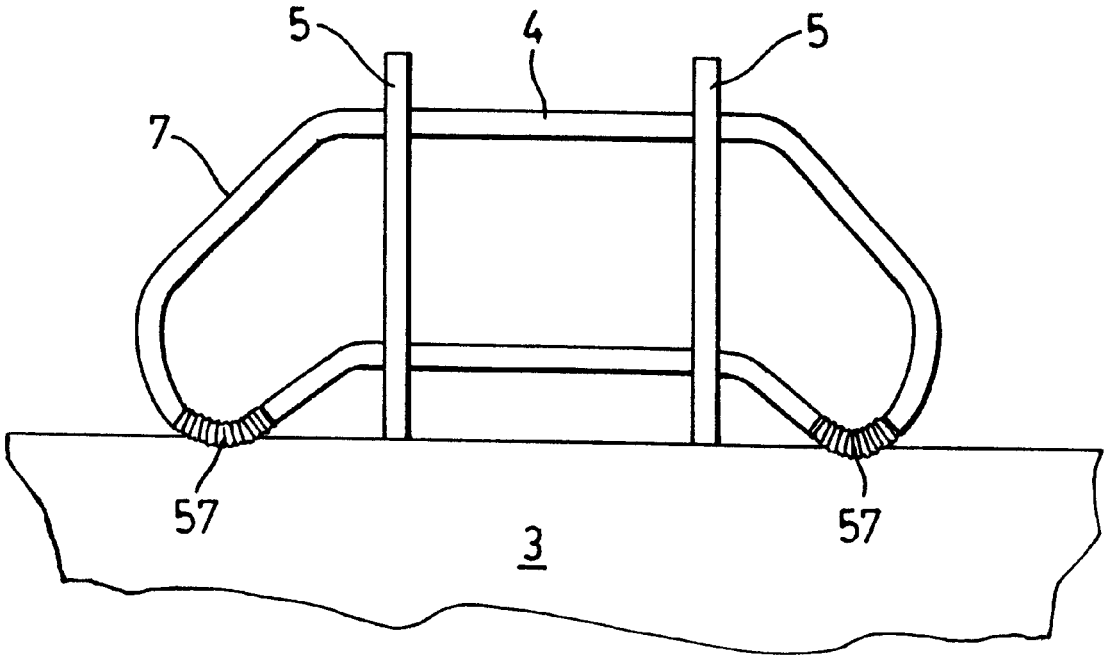
FIG. 2 is a rear view of the upper portion of the ladder shown in FIG. 1 having a pair of support arms attached thereto.

Referring first to FIGS. 1 and 2, an accessory pursuant to the present invention is shown and noted generally by reference numeral 1. Accessory 1 is releasably secured to a ladder 2 leaning against a building or structure 3. Ladder 2 is of the type having a series of generally parallel hollow, evenly spaced, tubular, open ended rungs 4 that span and pass through a pair of longitudinal side members 5. Typically during construction the ends of rungs 4 are passed completely through generally circular openings in side members 5 and crimped into place, thereby forming a series of passageways running across the ladder and generally evenly spaced along its length. In addition, to provide for a consistency between different ladders, manufacturers generally construct ladders such that the spacing between adjacent rungs is consistent between one ladder and the next.

While the enclosed figures depict an extension ladder, it will be appreciated by those skilled in the art that the present invention may be equally applied to a fixed length single section ladder or a step ladder. However, for discussion purposes reference will be made to the specific embodiment shown in the drawings depicting an extension ladder.

In FIGS. 1 and 2 accessory 1 comprises a pair of stabilizing arms 6 for stabilizing and supporting the ladder when leaned against building or structure 3. While in the preferred embodiment a pair of such stabilizing arms would be utilized, in some instances, for example when working on uneven roof or wall structures of a building, a single stabilizing arm could be employed. In one embodiment, stabilizing arm 6 has a generally U-shaped configuration with a pair of generally parallel leg members 7 that are spaced apart by a distance that approximates the distance between the centers of adjacent ladder rungs. In an alternate embodiment stabilizing arms 6 need not be generally U-shaped and leg members 7 may be non-parallel.

Figure 3:
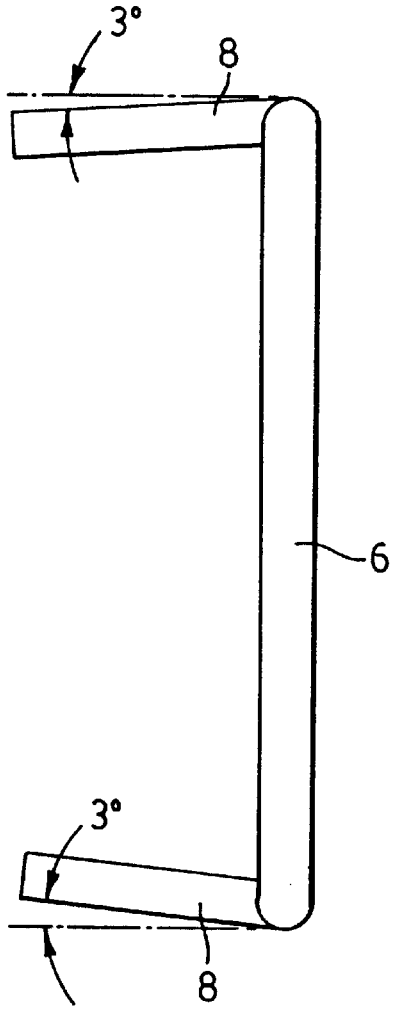
FIG. 3 is a rear view of one of the support arms shown in FIG. 1.
Figure 4:
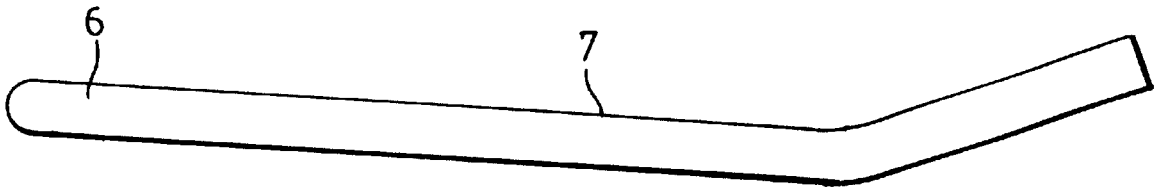
FIG. 4 is a top plan view of one of the support arms shown in FIG. 1.

Each of the leg members 7 end in a ladder rung engaging member 8 having a fore end 9 and an aft end 10 (see FIGS. 3 and 4). Ladder rung engaging members 8 are formed such that they are of a dimension that enables them to be receivable within the hollow interior 11 of the ladder rungs 4.

Figure 5:
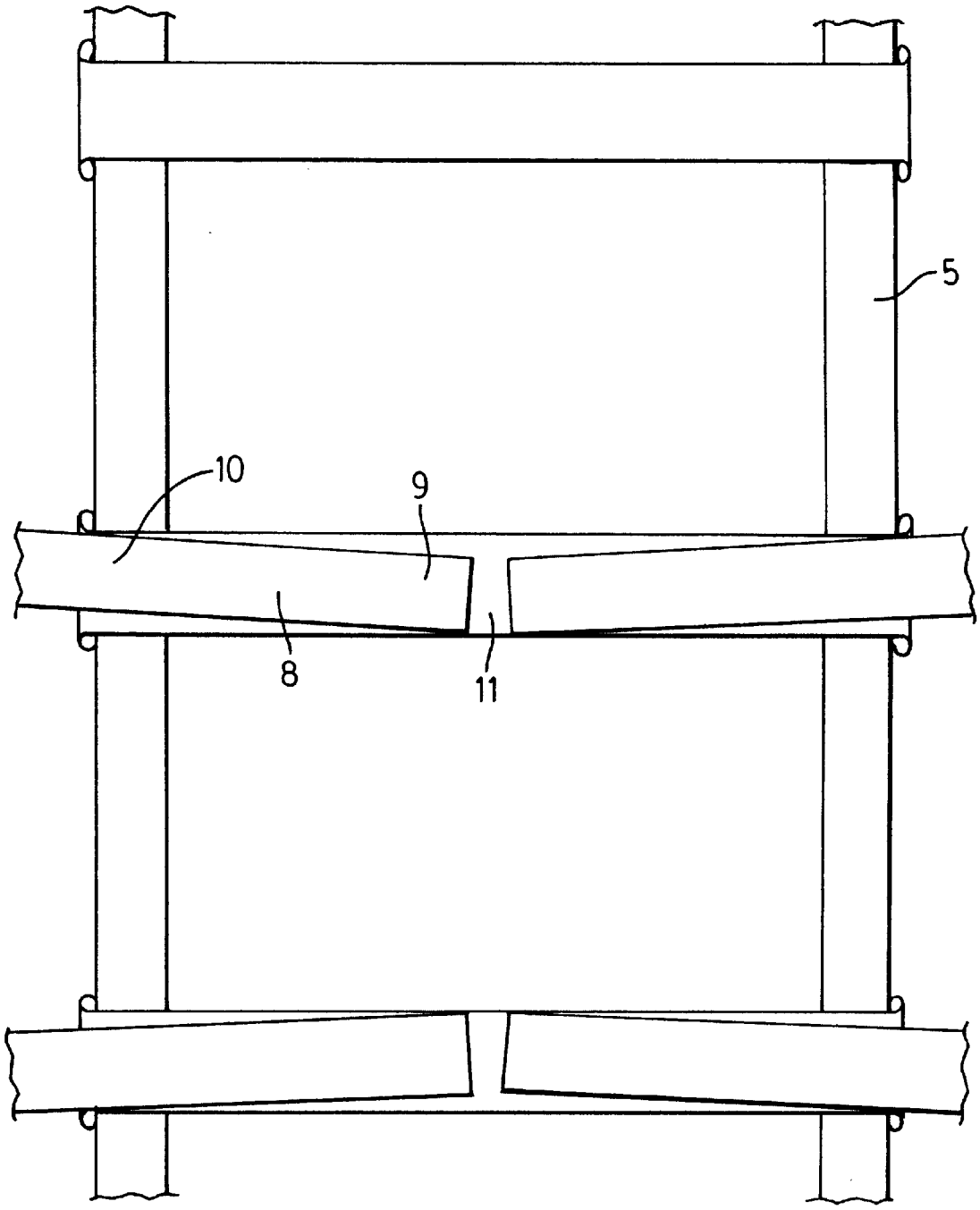
FIG. 5 is a sectional view taken along the line 5—5 of FIG. 1.

As is shown more specifically in FIGS. 3 and 5, ladder rung engaging members 8 are oriented in a convergent configuration such that when they are inserted into the hollow interiors 11 of ladder rungs 4 the fore ends 9 and aft ends 10 of members 8 bind against opposite sides of the interior 11 of ladder rungs 4, and thereby releasably secure stabilizing arms 6 to the ladder. By way of this structure, and as shown more particularly in FIG. 5, it will be appreciated that convergent ladder rung engaging members 8 will be more tightly held within hollow interiors 11 of the ladder rungs as they are pushed further into the ladder. In the preferred embodiment, stabilizing arm 6 is comprised of rigid aluminum, steel or other metallic pipe, however, a variety of other materials could equally be used. Accordingly the rigidity of ladder engaging members 8 will tend to increase the force by which they are retained within the hollow interiors of the ladder's rungs as they are pushed into the ladder and wedged in place.

It has been found that when the stabilizing arms are formed from pipe having a diameter of approximately 1 inch, an off-set bend or angle of convergence of approximately 3 degrees for ladder rung engaging members 8 is sufficient to allow them to bind and wedge within the ladder rungs and to thereby hold the stabilizing arm in place. Removal of the stabilizing arm from the ladder requires the application of an outward force upon ladder rung engaging members 8 to release them from their wedged position within hollow interiors 11. To ease the removal of ladder rung engaging members 8 from the rungs, it may in some cases be desirable to apply a slight inwardly directed force to leg members 7 such that they are bent slightly toward one another to relieve a portion of the force applied at the interface of the hollow interior of the ladder rungs and the aft ends 10 of ladder rung engaging members 8.

To provide increased lateral stability of the ladder when supported against the side of a building or structure, ladder rung engaging members 8 may be off-set from legs 7 of stabilizing arms 6 such that they form an obtuse angle therewith. This off-set will effectively result in stabilizing arms 6 also forming an obtuse angle with ladder rungs 4 when secured therein. As a result, the points of contact of stabilizing arms 6 with building or structure 3 will be widened beyond the width of ladder 2, thereby creating a more laterally stable structure (see FIG. 2). In addition, the surfaces or a portion of the surface of the stabilizing arms may include a protective covering 57 to prevent or reduce the marking of any building or structural surface against which they bear. Typically such protective coverings would be comprised of plastic, rubber or vinyl tubing.

Figure 6:
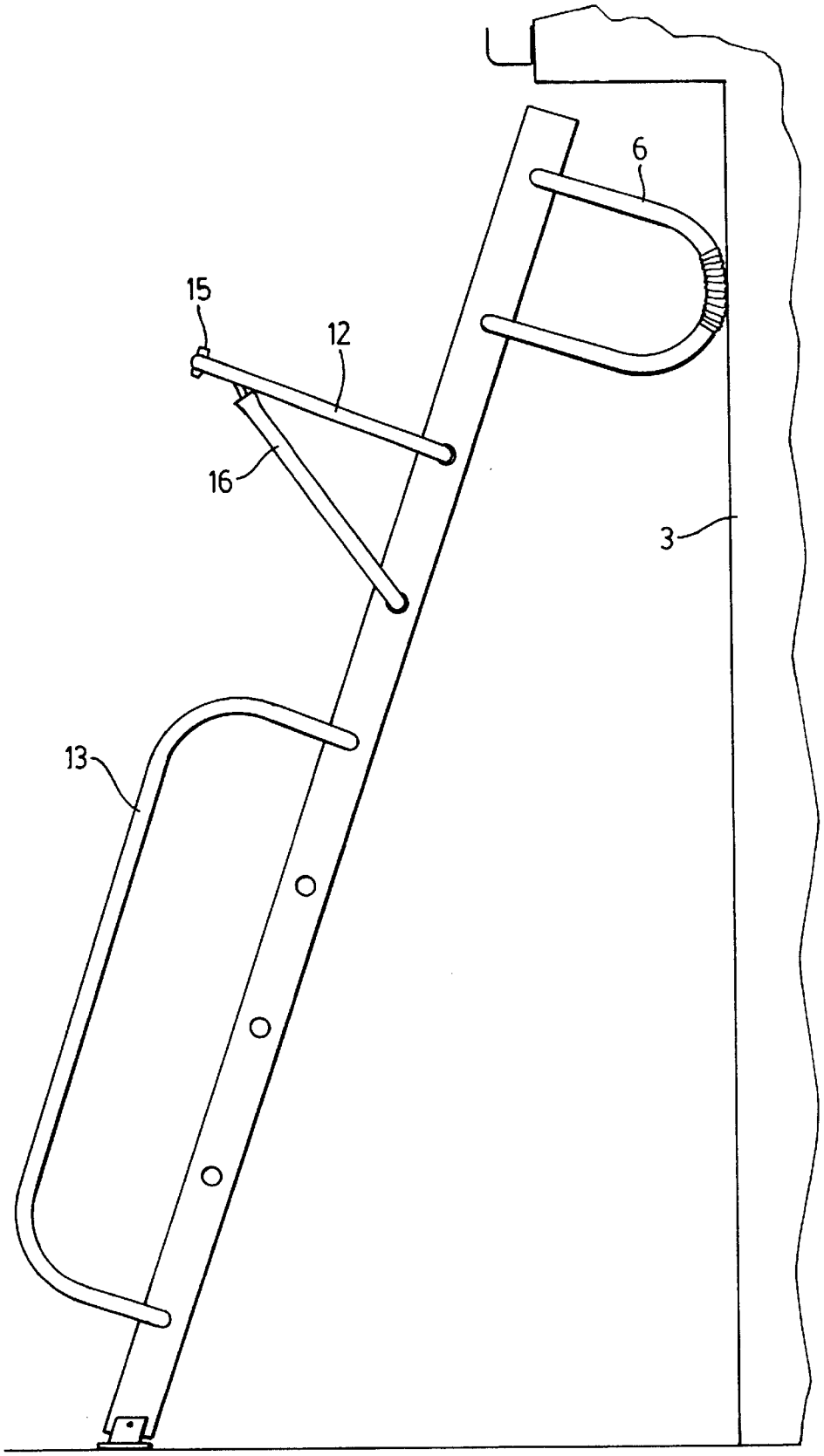
FIG. 6 is a side view of a ladder having attached thereto a plurality of ladder accessories according to the present invention wherein the accessories comprise a pair of support arms, a safety rail, and a pair of hand rails.
Figure 7:
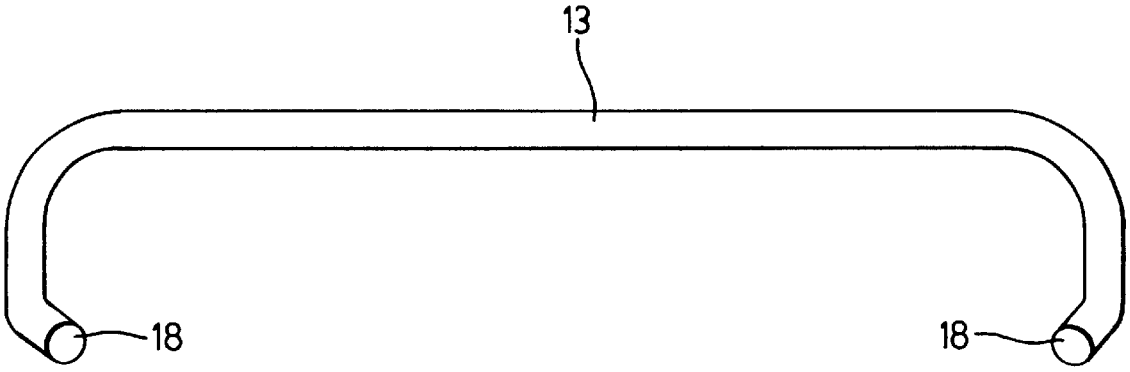
FIG. 7 is a side view of one of the hand rails shown in FIG. 6.
Figure 8:
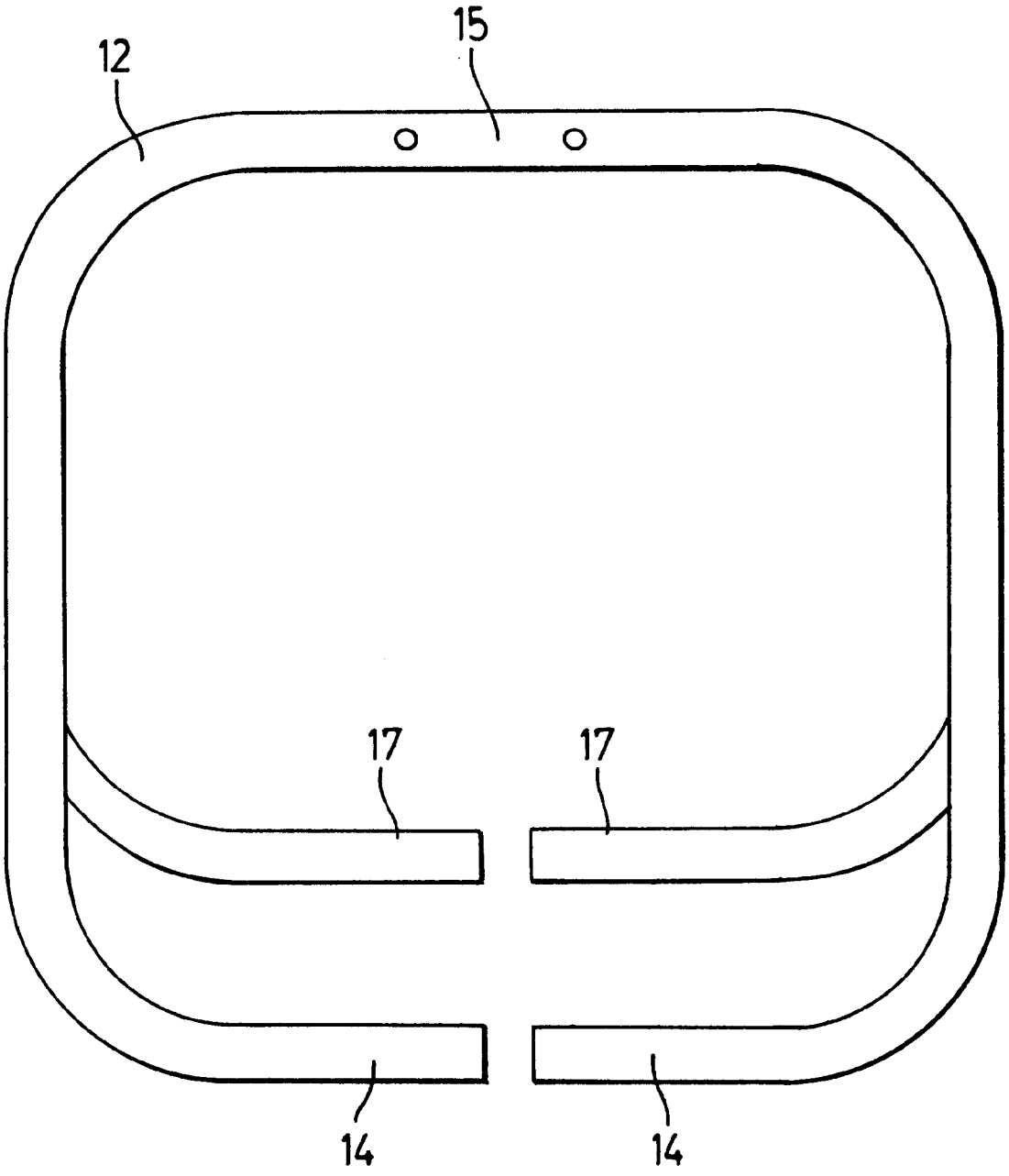
FIG. 8 is a top plan view of the safety rail shown in FIG. 6.

FIGS. 6 through 8 show an alternate embodiment of the present invention that includes a pair of stabilizing arms 6, as described above, in combination with a safety rail 12 and a pair of hand rails 13. Safety rail 12 includes at least one pair of leg members 14 that are releasably securable to opposite sides of ladder 2 such that when secured to the ladder safety rail 12 presents an enclosure to limit the likelihood of falls by an individual working on the ladder. Preferably leg members 14 of safety rail 12 are releasably securable within the hollow interiors 11 of the ladder's rungs.

Safety rail 12 further includes a coupling portion 15 that, when in an unlocked position, allows the safety rail to be extended in a lateral direction so as to permit insertion of leg members 14 into the ladder's rungs. Thereafter the safety rail may be retracted in its lateral direction and coupling member 15 locked in place to prevent extension of the safety rail and removal of the leg members from the ladder rungs. While it will be readily apparent to those skilled in the art that coupling portion 15 may be of a wide variety of different structures, in the preferred embodiment of the invention safety rail 12 is comprised of two primary sections held together by coupling portion 15 that is comprised primarily of an inner sleeve received within the ends of the two safety rail sections. In this manner the sections of the safety rail may be slid laterally apart to allow for leg members 14 to be inserted into the ladder rungs, and thereafter pushed together to secure the legs therein. The locking and unlocking of the coupling portion can be accomplished through the insertion of bolts or other fasteners through the safety rail 12 and the inner sleeve comprising coupling portion 15.

To help retain safety rail 12 in place along the length of the ladder, and to prevent leg members 14 from rotating within the hollow interiors of the ladder's rungs, one or more braces 16 may be utilized. As shown in FIGS. 6 and 8, braces 16 preferably have one end secured to an outer portion of safety rail 12 and have formed on their opposite end ladder engaging members 17 that are received within the hollow interior of one of the ladder's rungs. Ideally the length of braces 16 will be such that safety rail 12 is held in place while forming an approximate right angle with longitudinal side members 5 of ladder 2. In this manner the safety rail will present a fully enclosed railing or loop within which an individual can stand when working on the ladder. The safety rail will help to limit the likelihood of falls and also provides a barrier against which an individual can lean to allow him to utilize both of his hands when working on the ladder.

Referring specifically to FIGS. 6 and 7, hand rails 13 preferably include ladder rung engaging members 18 for receiving within the hollow interiors of the ladder's rungs. Ladder rung engaging members 18 enable the hand rails to be releasably secured to the ladder so as to provide a railing mechanism to assist individuals working and climbing on the ladder. When not needed, the hand rails may be merely removed and stored elsewhere.

In the preferred embodiment, both safety rail 12 and hand rails 13 are comprised of rigid aluminum pipe so that they are light weight, inexpensive, rigid, and easy to manufacture. However, the components may also be formed from steel or a variety of other materials. In the case of hand rails 13, ladder rung engaging members 18 are preferably formed and oriented in a convergent configuration, similar to that of the rung engaging members of stabilizing arm 6 described above, so as to enable members 18 to bind and wedge within the interior of the ladder's rungs, and to releasably secure the hand rails thereto. In the case of safety rail 12, ladder rung engaging members 17 of brace 16 and leg member 14 of the safety rail may be of a similar off-set nature (although not necessarily convergent) so as to also wedge within the interior of the ladder's rungs.

Figure 9:
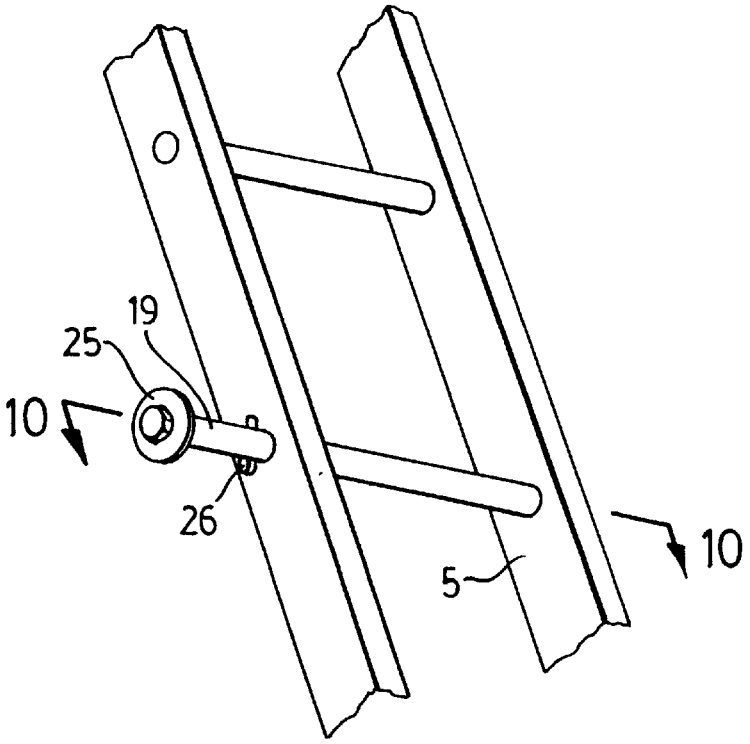
FIG. 9 is a side perspective view of a portion of a ladder having attached thereto an accessory according to the present invention wherein the accessory comprises a tool hanger.

In the third embodiment of the present invention (see FIGS. 9 and 10) there is disclosed an accessory for releasably securing to a ladder where the accessory comprises a tool hanger 19 having attached thereto a ladder rung engaging member 20. Ladder rung engaging member 20 is dimensioned so as to allow it to be inserted into the hollow interior 11 of a ladder rung 4 to releasably secure the tool hanger thereto. In the preferred embodiment ladder rung engaging member 20 is arched and has an upwardly convex construction, with a fore end 21, an apex 22 and an aft end 23.

Figure 10:
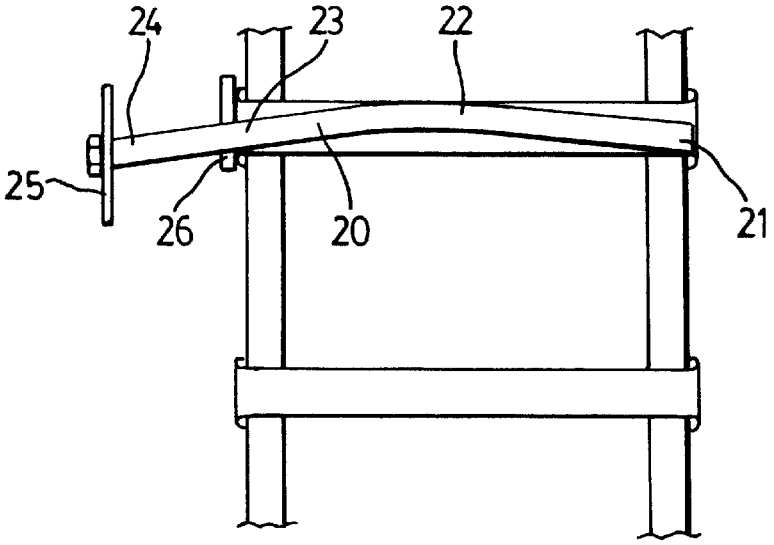
FIG. 10 is a section view taken along the line 10—10 of FIG. 9.
Figure 11:
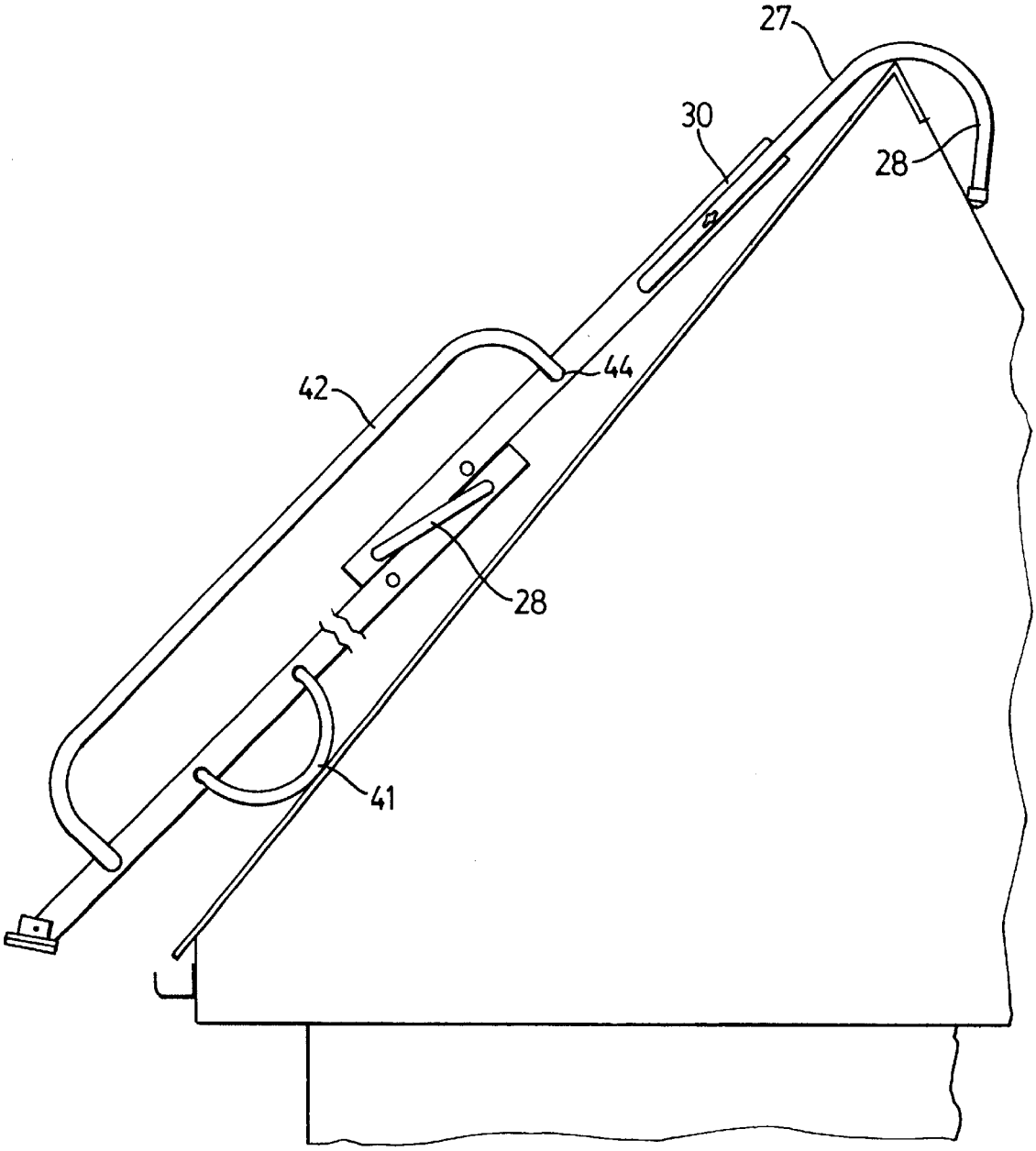
FIG. 11 is a side view of a ladder having attached thereto a plurality of ladder accessories according to the present invention wherein the accessories include a ridge hook, a pair of hand rails, a ladder lock, and a pair of set-off legs.

As shown in FIG. 10, the arched shape of ladder rung engaging member 20 results in the binding or wedging of member 20 within the interior 11 of ladder rung 4 by means of fore end 21, apex 22 and aft end 23 bearing against the interior surface of the ladder rung. This wedging of ladder rung engaging member 20 within hollow interior 11 prevents the accidental or unintended withdrawal of tool hanger 19 from the ladder's rung, and allows for hanging of tools, paint cans, clothing, and other articles from hanger 19. To enhance the ability of tool hanger 19 to retain articles thereon, its outer end 24 preferably includes means comprised of an enlarged generally circular flange that helps to prevent articles from slipping off the end of the tool holder. In addition, in the preferred embodiment tool hanger 19 may also include means to limit the depth of insertion of ladder rung engaging member 20 into hollow interior 11. Means 26 may be comprised of an enlargement of the surface of ladder rung engaging member 20 or, alternatively, may be comprised of a bolt, rod or screw 26 inserted to the side of member 20. The length of the portion of ladder rung engaging member 20 that may be received within hollow interior 11 is thereby limited through the abutment or engagement of means 26 with the outer surface of longitudinal side member 5 of the ladder.

Referring now to FIGS. 11 through 17, there is shown a yet further embodiment of the present invention comprising an accessory for releasably securing to an extension ladder that permits the ladder to be used on the inclined roof of a building or structure. The accessory generally comprises at least one ridge hook 27 and at least one ladder locking device 28. Ridge hook 27 includes a hook portion 29 and one or more ladder rung engaging members 31. Ridge book 27 is releasably securable to the upper end of the ladder through insertion of one or more of the ladder rung engaging members 31 into the hollow interior 11 of the ladder's rungs. With the ridge hook secured to the upper end of the ladder, hook portion 29 may be placed over the peak of the inclined roof of a building or structure to secure the ladder thereon.

Figure 13:
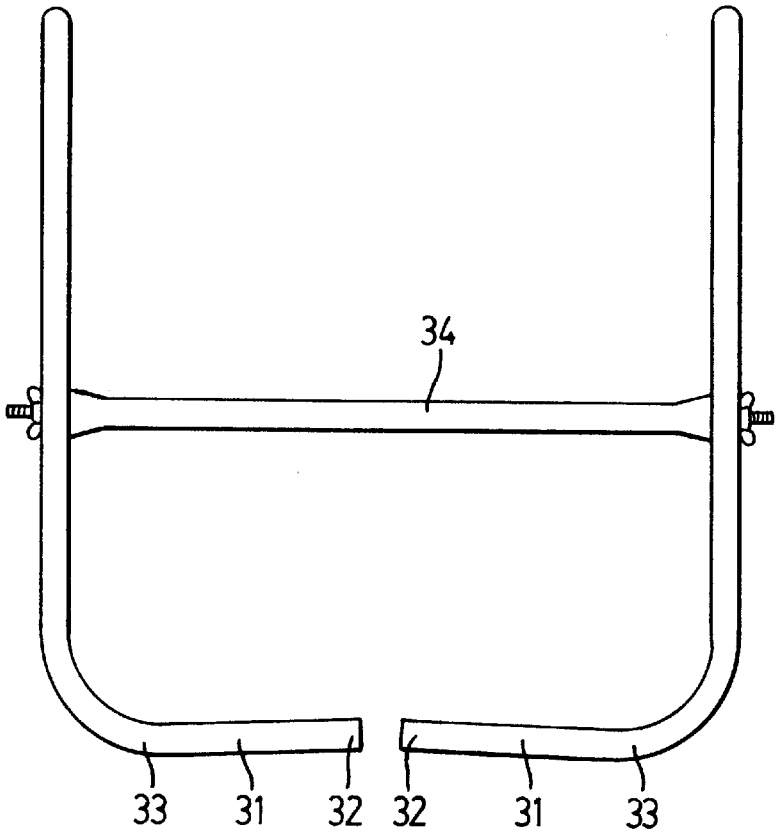
FIG. 13 is a front view of the ridge hook shown in FIG. 11.
Figure 14:
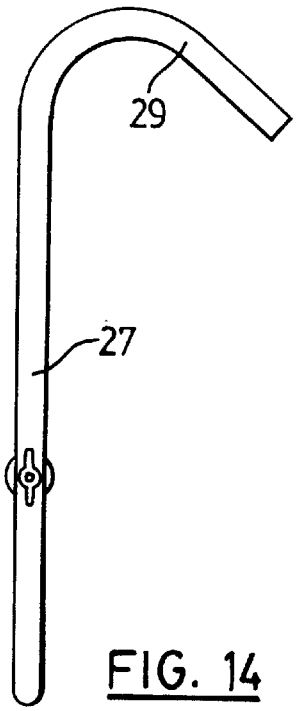
FIG. 14 is a side view of the ridge hook shown in FIG. 11.

As shown in FIG. 13, in the preferred embodiment ladder rung engaging members 31 form an acute angle with hook portions 29 such that they are off-set by approximately 3 degrees to perpendicular. In this manner, and in a similar fashion as described above with respect to ladder rung engaging members 8 on stabilizing arms 6, the fore end 32 and the aft end 33 of ladder rung engaging members 31 bind against opposite sides of the interior surface of the ladder rungs to releasably secure ridge hook 27 thereto.

Where a pair of ridge hooks are utilized and releasably secured to each side of the ladder, preferably a lateral brace 34 is received through the hollow interior of one of the ladder's rungs and releasably secured to each of the ridge hooks, adjacent to longitudinal side members 5 of the ladder. Typically lateral brace 34 is secured to the respective ridge hooks through the use of bolts or other mechanical fastening devices so as to more securely hold the ridge hooks in place and prevent their lateral movement about the end of the ladder.

Figure 12:
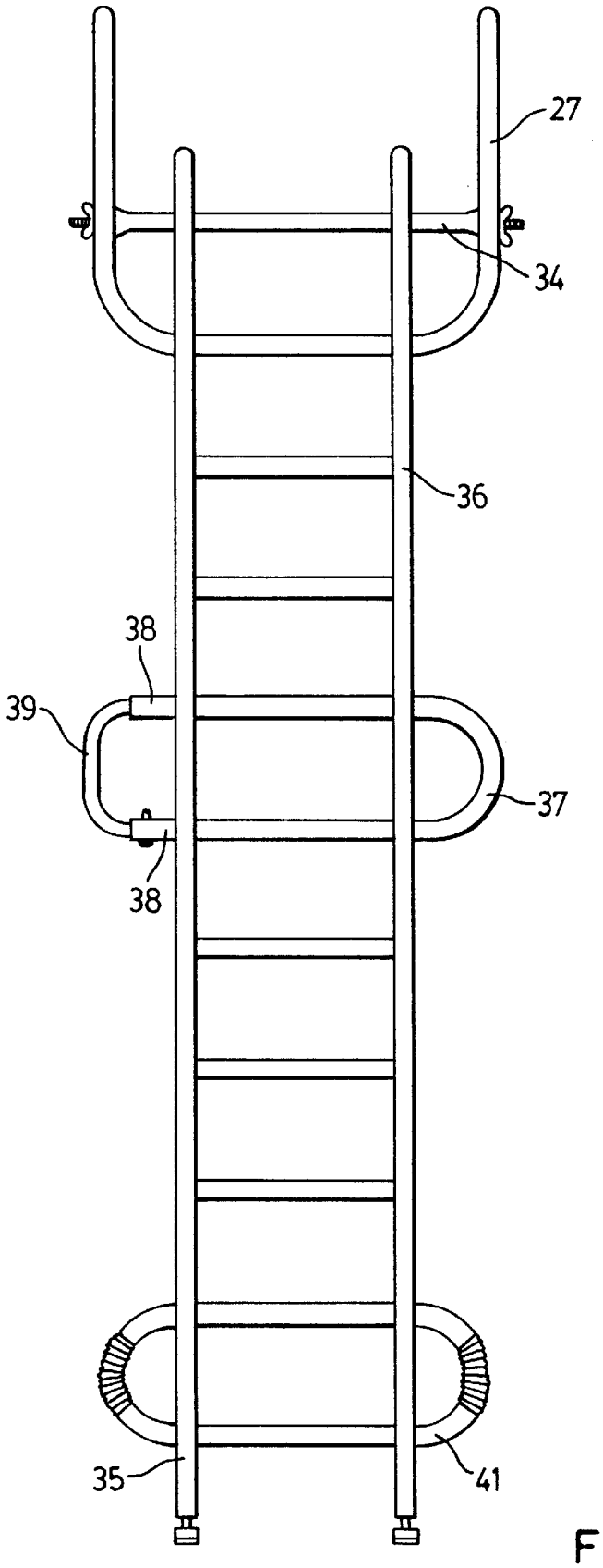
FIG. 12 is a front view of the ladder shown in FIG. 11.
Figure 15:
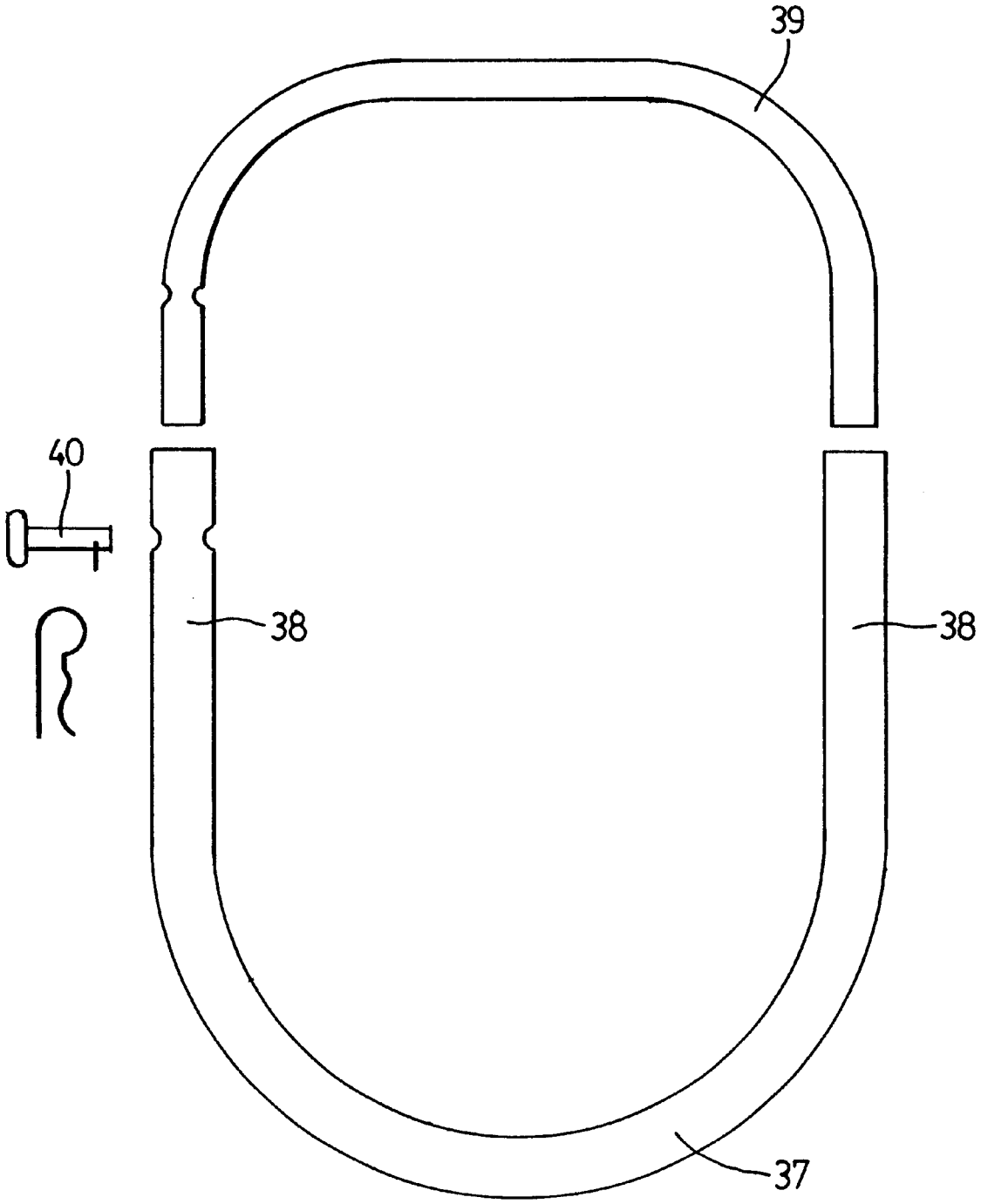
FIG. 15 is a front view of the ladder lock shown in FIG. 11.
Figure 16:
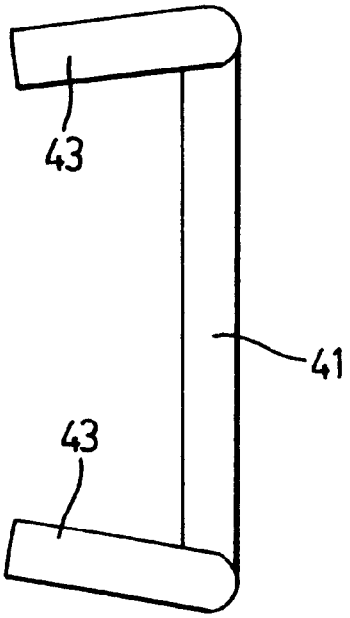
FIG. 16 is a front view of one of the set-off legs shown in FIG. 11.
Figure 17:
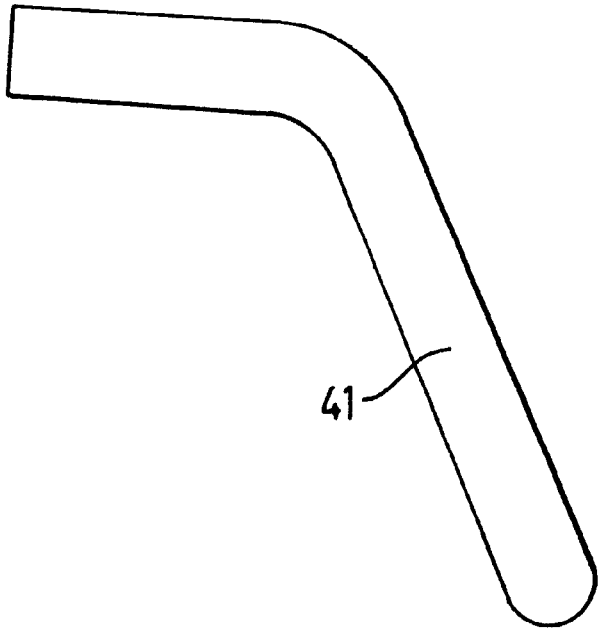
FIG. 17 is a top view of one of the set-off legs shown in FIG. 11.

As indicated above, the embodiment of the invention shown in FIGS. 11 through 16 also includes a ladder locking device 28. Ladder locking device 28 is utilized to releasably secure separate sections of an extension ladder together and prevent their accidental separation. It will be appreciated that such a device is critical when using an extension ladder hooked over the peak of an inclined roof of a building or structure through the use of ridge hooks 27. Under such circumstances without ladder locking device 28 the lower most section 35 could separate from the upper most section 36 and fall to the ground. The structure of ladder locking device is best shown in FIGS. 12 and 15. Locking device 28 essentially comprises a generally U-shaped tubular element 37 having a pair of generally parallel arms 38 that are spaced apart such that they may be received within the hollow interiors of two ladder rungs, one on lower ladder section 35 and one on upper ladder section 36. When received within the hollow interiors of the ladder rungs, a corresponding generally U-shaped locking bar 39 may be inserted into the ends of arms 38 and retained therein by a fastener 40, which is preferably a bolt, screw or pin. In this manner it will be appreciated that through insertion of one of arms 38 through a ladder rung on upper section 36 of the extension ladder, and the other arm 38 through a ladder rung on lower section 35, ladder locking device 28 will effectively secure the upper and lower sections of the extension ladder together and prevent their separation.

The embodiment of the invention shown in FIGS. 11 through 16 may further include at least one set-off leg 41 releasably securable to the ladder's rungs in order to elevate the ladder from the surface of an inclined roof when ridge hook 27 is received over the roof's peak. Preferably a pair of set-off legs 41 are utilized, with one leg releasably secured to each side of the ladder. The structure of set-off legs 41 is shown more specifically in FIGS. 11, 12, 16 and 17. Set-off legs 41 are of a similar construction as stabilizing arms 6 shown in FIGS. 1 through 5, with the exception that they are generally smaller in size.

The embodiment of the invention shown in FIGS. 11 through 17 also preferably includes a pair of hand rails 42, with one of the hand rails releasably securable to each side of the ladder, and thereby providing assistance to individuals working and climbing thereon. Hand rails 42 are of the same configuration as hand rails 13 described above and shown in FIG. 6. In the case of both set-off legs 41 and hand rails 42, each include ladder rung engaging members, 43 and 44 respectively. Ladder rung engaging members 43 and 44 are oriented in a convergent configuration such that their insertion into the hollow interiors of the ladder's rungs causes their fore and aft ends to bind against opposite sides of the interior surface of the rungs to releasably secure set-of legs 41 and hand rails 42 therein.

Figure 18:
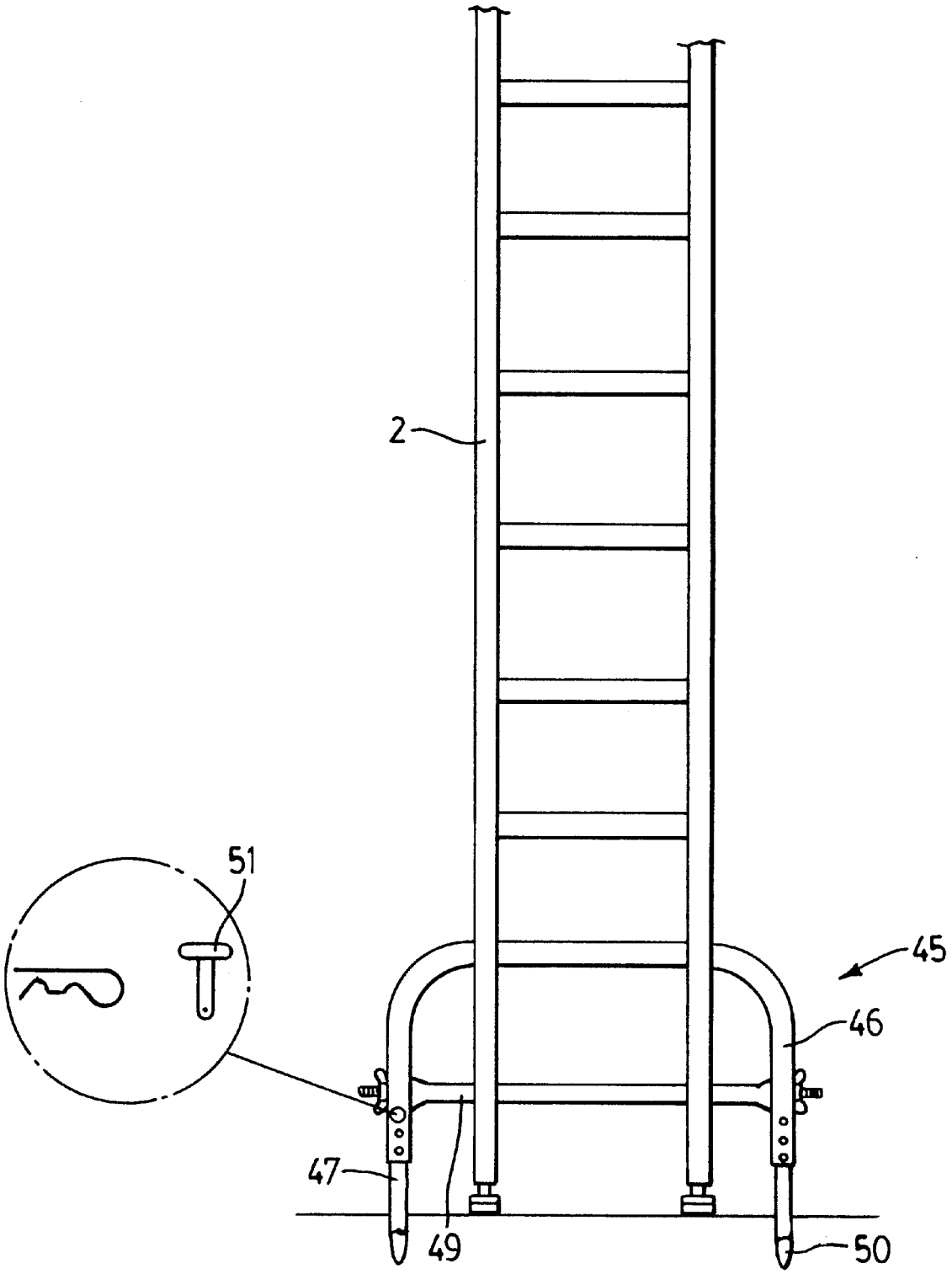
FIG. 18 is a front view of a ladder having attached thereto an accessory pursuant to the present invention wherein the accessory comprises an anti-kickback device.
Figure 19:
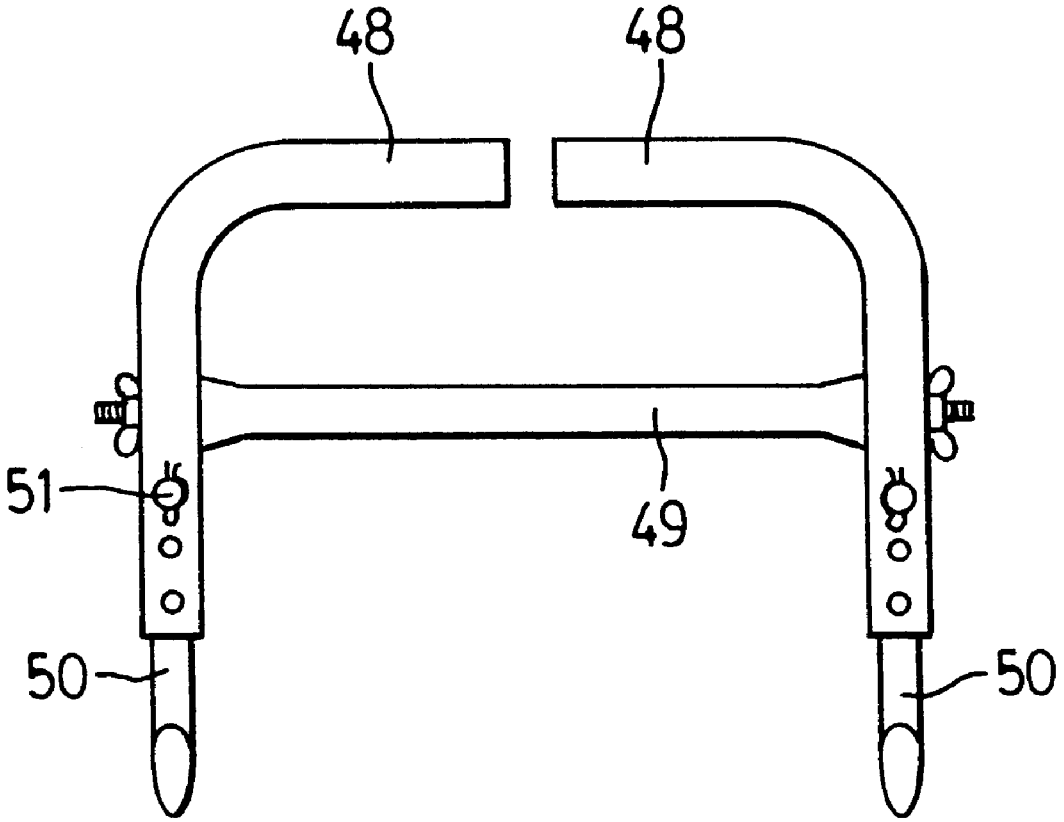
FIG. 19 is a front view of the anti-kickback device shown in FIG. 18.

Yet a further embodiment of the present invention is shown in FIGS. 18 and 19. Here the accessory according to the present invention is in the form of an anti-kickback device 45 to help prevent the unexpected or undesired movement of the base of a ladder when the ladder is oriented in an upright direction, or leaned against a building or structure. Anti-kickback device 45 is comprised of a pair of anchoring arms 46 that are releasably securable to rungs 4 of ladder 2. Anti-kickback device 45 further includes means 47 to rigidly secure the base of the ladder the ground, or to an object.

In a preferred embodiment, anchoring arms 46 have at one end ladder rung engaging members 48 that are receivable within hollow interior 11 of the ladder's rungs. Ladder rung engaging members 48 form an acute angle with anchoring arms 46 such that when the anchoring arms are positioned adjacent and generally parallel to the longitudinal side members of the ladder, with ladder rung engaging members 48 inserted into the hollow interior of the rungs, the fore and aft ends of ladder rung engaging members 48 bind on opposite sides of the interior surface of the ladder rungs to releasably secure anchoring arms 46 thereto.

So as to more securely hold ladder rung engaging members 48 within the hollow interior of the ladder's rungs, and to maintain anchoring arms 46 adjacent to and generally parallel with the longitudinal side members of the ladder, a brace 49 is receivable through the hollow interior of one of the ladder's rungs such that it is attachable to each of the anchoring arms on opposite sides of the ladder. A fastener, which may include a bolt, screw, threaded stud etc., is then used to releasably secure both distal ends of brace 49 to the respective anchoring arms 46 and thereby provide enhanced stability and rigidity to anti-kickback device 45.

Where a ladder is to be used on sod or a relatively soft earthen surface, each of the anchoring arms 46 may include a downwardly projecting spike 50 that can be pressed into the ground's surface to help prevent unexpected or undesired movement of the base of the ladder. Spike 50 may be formed integrally with the lower ends of anchoring arms 46. Alternatively, spike 50 may be a separate component releasably securable to the lower end of the anchoring arms. Where spikes 50 are formed as separate components, anchoring arms 46 are preferably constructed so as to enable the length of the spikes to be adjusted according to the type of ground surface upon which the ladder is placed. That is, for soft surfaces it may be desirable to adjust the length of the spikes such that they extend downwardly to their maximum level. Alternatively, where the surface is relatively hard and somewhat impermeable to insertion of the spike, their length may be adjusted such that they extend below the lower end of the ladder to only a minimal degree. Typically the adjustment of the length of spikes 50 would be accomplished through the insertion of a pin, bolt or screw 51 through spike 50 and through one of a series of holes passing through the lower end of anchoring arms 46 (see FIG. 19). Under this configuration the spikes would preferably be comprised of a solid aluminum, steel or other rigid product whereas anchoring arms 46, ladder rung engaging members 48, and brace 49 would be preferably comprised of rigid aluminum, steel or piping.

Figure 20:
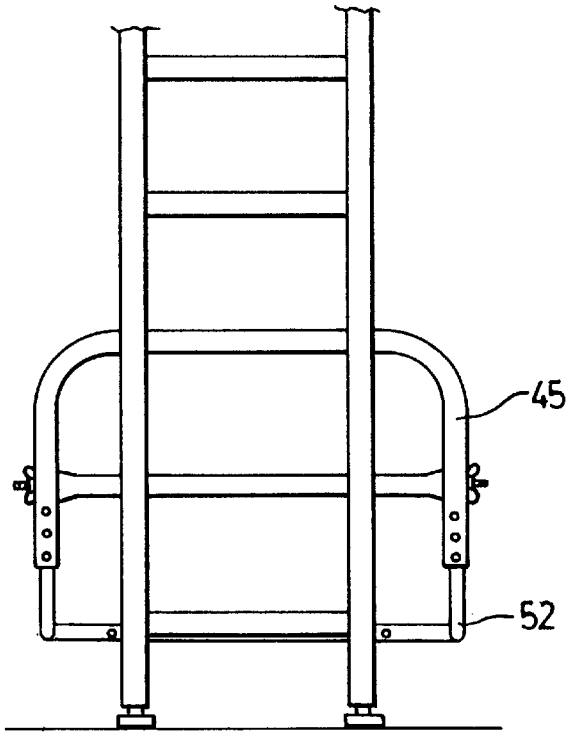
FIG. 20 is a front view of a ladder having attached thereto an anti-kickback device of an alternate embodiment to that shown in FIG. 18.
Figure 22:
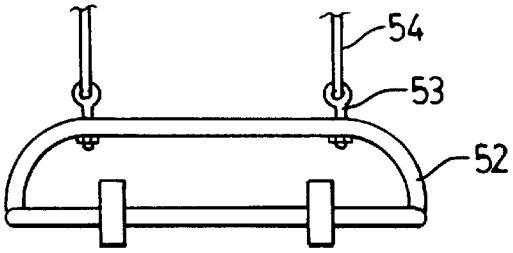
Figure 21:
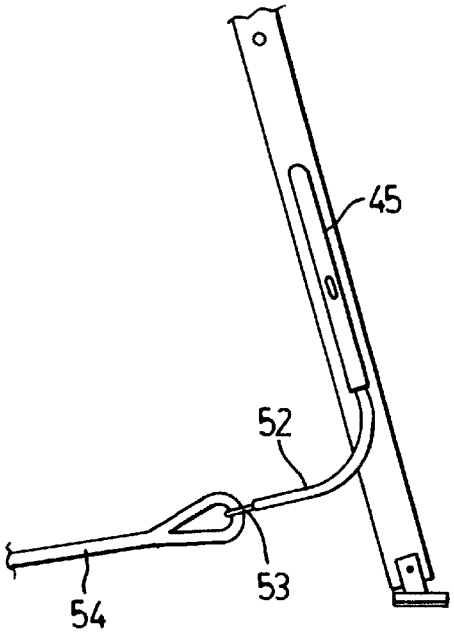
FIG. 21 is a side view of the ladder and anti-kickback device shown in FIG. 20; and, FIG. 22 is a top view of the ladder and anti-kickback device shown in FIG. 20.

An alternate embodiment of anti-kickback device 45 is shown in FIGS. 20 through 22. Here anti-kickback device 45, rather than utilizing a pair of spikes, includes means 52 to permit anchoring arms 46 to be connected by way of a rope, cable or chain to an object positioned behind the ladder when the ladder is in an upward orientation. Means 52 may comprise a pair of eye bolts 53 to which one end of a rope, cable, chain or strap 54 may be connected with the other end connected to a secure object, building or structure. This configuration of anti-kickback device 45 will prevent the lower end of the ladder from sliding outwardly away from a building or structure when the ladder is leaned up against the building. It will be appreciated that use of this structure may be preferable where the ladder is placed on concrete or other hard surface.

The primary components of the accessories according to the present invention are comprised of a rigid aluminum, steel or other rigid piping material that is relatively stiff and strong, will not add significantly to the weight of the ladder, lends itself to ease of manufacturing through bending, braking and crimping, and is economical to use. As discussed, the accessories of the present invention include one or more ladder rung engaging members that are releasably receivable within the hollow interior of the ladder's rungs so as to provide a means, or to assist, in the securement of the accessory to the ladder. The off-set, or convergent, nature of the ladder rung engaging members, as the case may be, generally causes the fore and aft ends of the ladder rung engaging members to bind against opposite sides of the interior surface of the rungs. This binding or wedging of the ladder rung engaging members within the hollow rungs has been proven to be both a simple and effective method of releasably securing the accessories to the ladder.

Finally, in yet a further embodiment of the invention there may be provided a kit of accessories releasably securable to a ladder to expand the uses of the ladder and enhance the ladder's safety features. The kit may comprise of pair of stabilizing arms 6, a pair of hand rails 13, and an anti-kickback device 45 that includes a pair of anchoring arms 46. The kit may also include at least one ridge hook 37 that can be releasably secured to the upper end of an extension ladder to allow the ladder to be received over and supported from the peak of a building or structure. Where the kit includes a ridge hook 27, it also preferably includes a ladder locking device 28 to prevent the accidental separation of the sections of a multi-section extension ladder. That kit may also include a pair of set-off legs 41 to elevate the ladder from the roof of a building or structure when retained thereon through the use of the ridge hook.

It is to be understood that what has been described are the preferred embodiments of the invention and that it may be possible to make variations to these embodiments while staying within the broad scope of the invention. Some of these variations have been discussed while others will be readily apparent to those skilled in the art.

The embodiments of the invention in which an exclusive property or privilege is claimed are defined as follows:

1. An accessory for releasably securing to a ladder, the ladder being of the type having a series of generally parallel, hollow, evenly spaced, tubular, open ended rungs spanning and passing through a pair of longitudinal side members, the accessory comprising at least one stabilizing arm for stabilizing and supporting the ladder when leaned against a building or structure, said stabilizing arm having a generally U-shaped portion with a pair of generally parallel leg members extending from respective free ends of the generally U-shaped portion and in a plane at an angle to a plane of said generally U-shaped portion, said leg members spaced apart by a distance to approximate the distance between the centers of a pair of ladder rungs, each of said leg members ending in a ladder rung engaging member having a fore and an aft end and receivable within the hollow interior of a ladder rung, said ladder rung engaging members oriented in a convergent configuration with respect to each other such that insertion of said ladder rung engaging members into the hollow interiors of a pair of ladder rungs causes said fore and aft ends of said ladder rung engaging members to bind against opposite sides of the interior surfaces of the ladder rungs to releasably secure said stabilizing arm to the ladder.

2. The device as claimed in claim 1 wherein said accessory comprises a pair of said stabilizing arms, said stabilizing arms being releasably securable to opposite sides of the ladder to enhance the stability of the ladder when in use.

3. The device as claimed in claim 2 wherein said ladder rung engaging members converge at an angle of approximately 3 degrees.

4. The device as claimed in claim 3 wherein said stabilizing arms include protective coverings to prevent marking of a surface against which they bear.

5. The device as claimed in claim 4 wherein said stabilizing arms are comprised of rigid aluminum or steel pipe.

6. An accessory for releasably securing to a ladder, the ladder being of a type having a series of generally parallel, hollow, evenly spaced, tubular, open ended rungs spanning and passing through a pair of longitudinal side members, the accessory comprising at least one stabilizing arm for stabilizing and supporting the ladder when leaned against a building or structure, said stabilizing arm having a body portion and a pair of leg members extending from respective free ends of said body portion and in a plane at an angle to a plane of said body portion, said leg members at their opposite ends ending in ladder rung engaging members, said ladder rung engaging members having a fore and an aft end and receivable within the hollow interior of a ladder rung, said ladder rung engaging members oriented in a convergent configuration with respect to each other such that insertion of said ladder rung engaging members into the hollow interiors of a pair of ladder rung causes said fore and aft ends to bind against opposite sides of the interior surfaces of the ladder rungs and to thereby releasably secure said stabilizing arm to the ladder.

* * * * *